US008661618B2

(12) United States Patent
Jablonski

(10) Patent No.: US 8,661,618 B2
(45) **Date of Patent: *Mar. 4, 2014**

(54) HINGE ASSEMBLY

(71) Applicant: Paul Jablonski, Jupiter, FL (US)

(72) Inventor: Paul Jablonski, Jupiter, FL (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/757,537

(22) Filed: Feb. 1, 2013

(65) Prior Publication Data

US 2013/0212836 A1 Aug. 22, 2013

Related U.S. Application Data

(63) Continuation-in-part of application No. 13/400,803, filed on Feb. 21, 2012, now Pat. No. 8,522,400.

(51) Int. Cl.
*E05D 11/10* (2006.01)

(52) U.S. Cl.
USPC ..... 16/320; 16/352; 16/326; 16/327; 16/331

(58) Field of Classification Search
USPC ..... 16/320, 326–328, 351, 352, 353, 380, 16/386, 230–232, 258, 262, 265, 270; 292/251.5, 253, 254, 106, 137, 341.15, 292/341.17, 359
See application file for complete search history.

(56) References Cited

U.S. PATENT DOCUMENTS

| | | | | | |
|---|---|---|---|---|---|
| 872,650 | A * | 12/1907 | Gilroy | 16/330 |
| 1,563,869 | A * | 12/1925 | Larson | 16/243 |
| 3,231,928 | A * | 2/1966 | Grunert | 16/357 |
| 3,390,420 | A * | 7/1968 | Foltz | 16/276 |
| 3,401,422 | A * | 9/1968 | Ventura | 16/54 |
| 3,448,486 | A * | 6/1969 | Wright | 16/324 |
| 3,475,784 | A * | 11/1969 | Foltz | 16/380 |
| 3,744,085 | A * | 7/1973 | Griego | 16/325 |
| 3,874,029 | A * | 4/1975 | McCullough | 16/329 |
| 3,903,567 | A * | 9/1975 | Suska | 16/301 |
| 4,384,375 | A * | 5/1983 | Gerome | 4/240 |
| 4,475,266 | A * | 10/1984 | Suska | 16/273 |
| 4,501,045 | A * | 2/1985 | Boyer | 16/331 |
| 4,844,519 | A * | 7/1989 | Dagon | 292/57 |
| 4,848,812 | A * | 7/1989 | Slaughter | 292/144 |
| 4,999,937 | A * | 3/1991 | Bechtold | 40/610 |
| 5,362,116 | A * | 11/1994 | Doyle et al. | 292/144 |
| 6,553,626 | B2 * | 4/2003 | Coburn | 16/386 |
| 7,000,290 | B1 * | 2/2006 | Ace | 16/386 |
| 7,610,684 | B2 * | 11/2009 | Steinich | 33/1 PT |
| 7,891,056 | B2 * | 2/2011 | McAfee | 16/374 |
| 2007/0157432 | A1 * | 7/2007 | Weinstein | 16/320 |
| 2010/0218344 | A1 * | 9/2010 | Van Gennep | 16/327 |

(Continued)

*Primary Examiner* — Chuck Mah
(74) *Attorney, Agent, or Firm* — Michael P. Mazza LLC

(57) ABSTRACT

A hinge assembly is movable between open and closed positions and capable of being locked in an open position. The hinge assembly comprises first and second hinge members including, respectively, first and second body portions. A hinge pin assembly cooperates with the hinge members and has aligned internal bores and a longitudinal axis about which the hinge members rotate. A locking pin is movable within the internal bores between a first position and a second position. When the locking pin is in the first position the hinge members cannot rotate relative to one another, and when the locking pin is in the second position the hinge members can rotate relative to one another. A magnetic latch member is mounted to one of the hinge members to hold the locking pin in one of the first or second positions. The locking components may include a mechanical override device to prevent damage.

7 Claims, 6 Drawing Sheets

(56) References Cited

U.S. PATENT DOCUMENTS

2011/0094058 A1* 4/2011 Van Gennep ..... 16/327
2011/0254285 A1* 10/2011 Hanchett, Jr. ..... 290/1 R
2012/0066863 A1* 3/2012 Cayer ..... 16/230

* cited by examiner

HINGE ASSEMBLY

This application is a continuation in part of U.S. patent application Ser. No. 13/400,803, filed Feb. 21, 2012.

BACKGROUND OF THE INVENTION

The present invention relates generally to hinges and, more particularly, to a hinge assembly useful in stopping or preventing the movement of a structure carried by the hinge or with which the hinge is operationally affixed. The present invention finds useful application when used with gates that form a part of the enclosure for swimming pools or other potentially hazardous sites, where building codes often require the use of self closing gates to minimize the hazard to children.

It is known in the art that such self closing gates pose an inconvenience in circumstances where continuing ingress and egress from the enclosed area is desired. For example, when a pool or yard is being serviced, the service personnel often have a need to enter and leave the area while carrying equipment and service implements. At such times, it is much more convenient to keep the gate in an open position, and various devices have been proposed for this purpose. However, these prior devices suffer from a variety of disadvantages, such as cost, complexity, difficulty of installation and undesirable aesthetics. Many such prior art locking devices require modifications to the adjoining structures or walkways and may create some obstruction to the passageway serviced by the gate.

SUMMARY OF THE INVENTION

The present invention is directed to a device which addresses the above mentioned need, to maintain a self closing gate in an open position, while overcoming the disadvantages of the known prior art. The invention is directed to a simple, inexpensive, easily installed and aesthetically pleasing device which allows a self closing gate to be easily held in one or more open positions thereby facilitating passage into and out of the area enclosed by the gate and its associated fencing. When not in use, the device is inconspicuous and occupies no space or location which might prove inconvenient. In addition, no modifications to the surroundings, such as holes in adjacent walkways, are required.

The present invention, in one preferred embodiment, is directed to a hinge assembly movable between open and closed positions and capable of being held or locked in an open position. The hinge assembly comprises a first hinge leaf including a generally cylindrical first body portion or knuckle and a second hinge leaf including a generally cylindrical second body portion or knuckle. The first and second knuckles of the two hinge leaves have a common longitudinal axis, and cooperate with a hinge pin assembly, so that the first and second hinge leaves are rotatable to move the hinge assembly between the open and closed positions. The hinge pin assembly has first and second segments with aligned internal bores configured with non circular cross sections. A lock bar is movable within the internal bores of the first and second hinge pin segments and has a cross section configured to engage the internal bores and prevent rotation of the hinge leaves. The lock bar is movable longitudinally within the internal bores of the first and second hinge pin segments between a first position and a second position, so that when the lock bar is in the first position the first and second hinge leaves cannot rotate relative to one another and when the lock bar is in the second position the first and second hinge leaves can rotate relative to one another. A magnetic latch member is mounted to one of the first or second hinge members to hold the lock bar in one of the first or second positions.

In accordance with a further preferred embodiment of the invention, the hinge assembly includes a force relief mechanism to prevent catastrophic failure of the hinge in the event substantial force is applied to the gate while the hinge assembly is in the locked position. Due to the large moment arm that is created by the gate itself, forces input to the gate are greatly amplified at the hinge and malfunction or permanent damage may arise without some mechanism to relieve these forces. In one form, the relief mechanism utilizes a set screw positioned to maintain the locking function of the hinge assembly, but allowing the two hinge leaves to rotate even when in the locked position upon application of substantial gate closing forces.

BRIEF DESCRIPTION OF THE DRAWINGS

The novel features which are characteristic of the present invention are set forth in the appended claims. However, the invention's preferred embodiments, together with further objects and attendant advantages, will be best understood by reference to the following detailed description taken in connection with the accompanying drawings in which:

DETAILED DESCRIPTION OF THE PREFERRED EMBODIMENTS

Figure 1A:
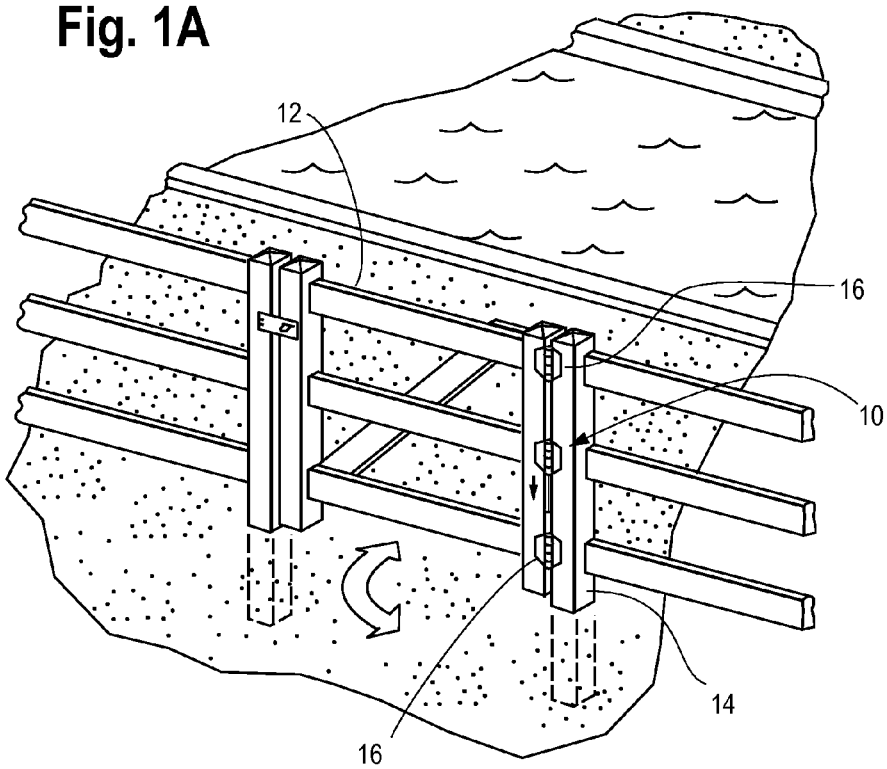
FIGS. 1A and 1B illustrate one preferred embodiment of the invention as used in a typical installation on a gate for a swimming pool enclosure.
Figure 1B:
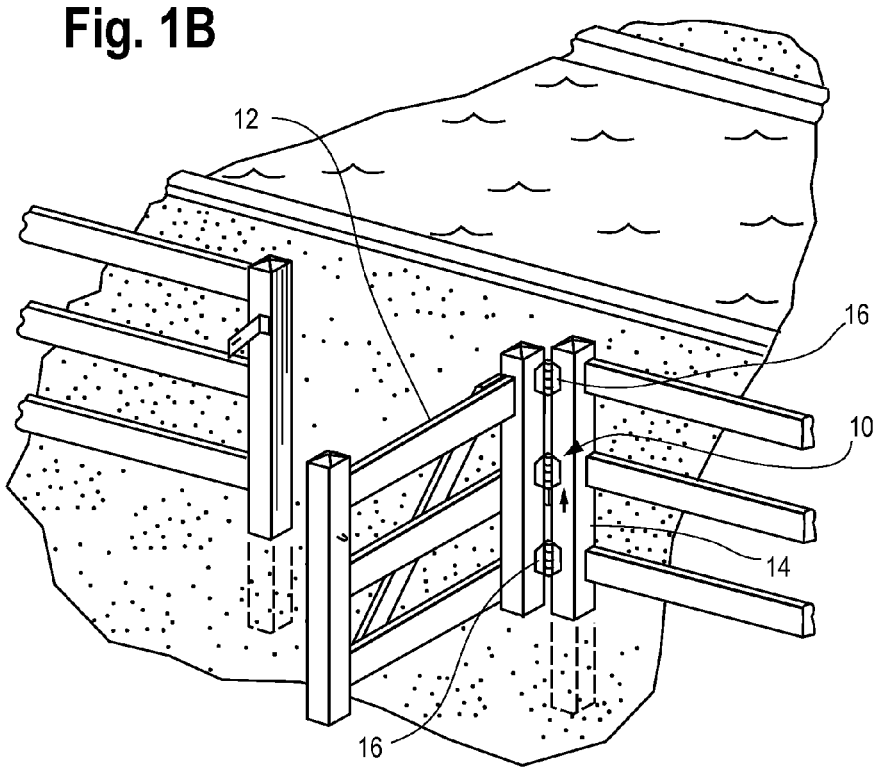
Figure 2:
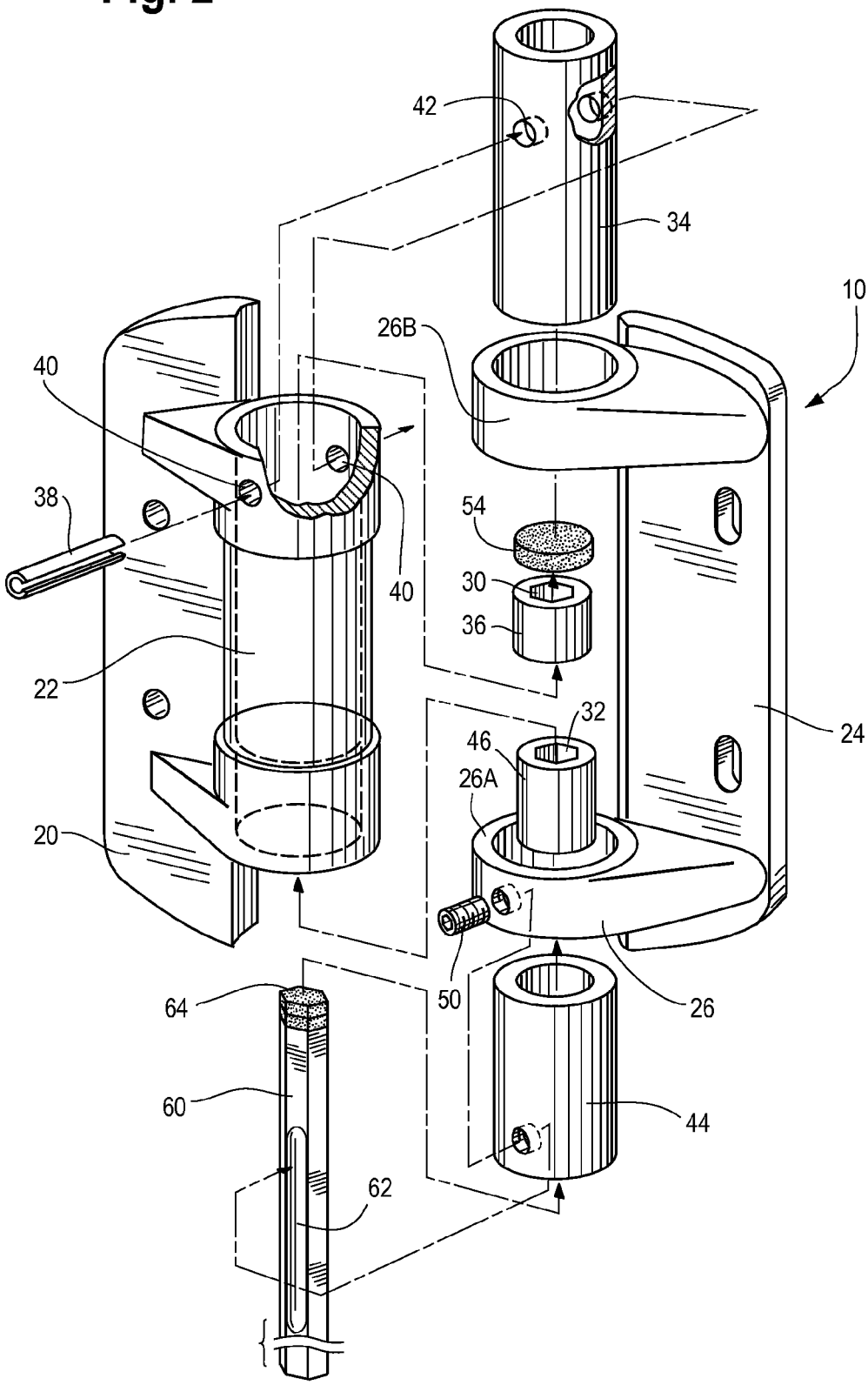
FIG. 2 is an exploded perspective view of one preferred embodiment of the invention showing the details of construction for various components of the hinge assembly.
Figure 3:
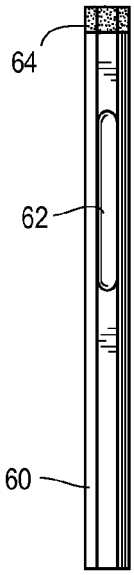
FIG. 3 is a side elevation view of the locking pin used in the embodiment shown in FIG. 2.
Figure 4:
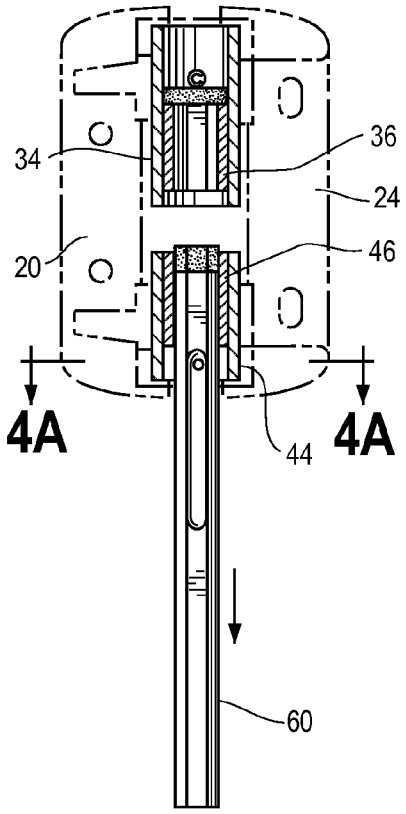
FIG. 4 is a partial cross sectional view illustrating the embodiment shown in FIG. 2 with the locking pin positioned to permit free rotation of the hinge assembly.

With reference to F*igs*. 1A and 1B, a hinge assembly 10, made in accordance with one preferred embodiment of the present invention, is shown in a typical installation on a gate 12 forming part of an enclosure for a swimming pool. The gate 12 is mounted to a gate post 14 by hinge assembly 10 and self closing hinges 16. The self closing hinges 16 include a spring biasing mechanism so that when the gate is opened it will automatically return to the closed position. The hinge assembly 10 includes components that allow the gatel2 and hinges 16 to swing freely to and from a closed position, shown in FIG. 1A, and an open. position, shown in FIG. 1B. In addition, hinge assembly 10 includes components that, when actuated as discussed further below, will hold the gate 12 in the open position against the biasing forces of hinges 16. Of course, the invention may be used in other environments and with any structure where a need exists for maintaining the structure in a fixed rotational orientation.

With reference now to FIGS. 2-7B, the components used in the design of the preferred embodiments and their function will be explained. The hinge assembly 10 includes a first hinge member or hinge leaf 20, having a generally cylindrical first body portion or knuckle 22, and a second hinge member or hinge leaf 24, having a generally cylindrical second body portion or knuckle 26. In the illustrated embodiment, the second knuckle 26 has spaced lower and upper segments, 26A and 26B, positioned adjacent the bottom and top of the first knuckle 22, The first and second knuckles, 22 and 25, have a common longitudinal axis and cooperate with a hinge pin assembly so that the first and second hinge leaves, 20 and 24, can rotate relative to one another to move the hinge assembly between open and closed positions. In the illustrated embodiment, the hinge pin assembly includes an upper component comprising sleeve 34 and insert 36 along with a lower component comprising sleeve 44 and insert 46, The insert 36 is press fit into sleeve 34 and configured with a non circular bore 30. A retaining pin 38 is positioned within holes 40 and 42. As a result, hinge knuckle 22, sleeve 34 and insert 36 all rotate together. Likewise, the insert 46 is press fit within sleeve 44 and configured with a non circular bore 32. A set screw 50 is located just below the insert 46 and fixes the position of sleeve 44 within knuckle segment 26A. As a result, the knuckle 26, sleeve 44 and insert 46 all rotate together. In addition, the inside end of the set screw 50 extends into the internal bore 32 of insert 46. Those of skill in the art will appreciate that the upper and lower hinge pin assembly components, with non circular internal bores, may be fabricated in other ways, by molding or casting for example, and without need of separate sleeves and inserts. in other words, the sleeve 34 and insert 36 may be fabricated as a single unitary part, and so too can the sleeve 44 and insert 46. Also, while the non, circular internal bores 30 and 32 are shown to be hexagonal, other non circular configurations may be implemented.

A magnet 54 is housed within hinge knuckle 22 and held in place between pin 38 and insert 36. The function of magnet 54 will be described below.

A lock bar or rod 60 is employed with the hinge assembly 10 and may be positioned to prevent movement of, or lock, the first and second hinge leaves 20 and 24. The lock bar 60 is configured so that when inserted into the internal bores 30 and 32, it cannot rotate within the hinge pin assembly. In the illustrated embodiment, the lock bar 60 has a hexagonal cross section matching the cross sections of bores 30 and 32. In addition, lock bar 60 has a longitudinal groove 62 and one end 64 composed of a ferrous material. Lock bar 60 is positioned within insert 46 so that its groove 62 is aligned with set screw 50. The inside end of set screw 50 extends into groove 62 and acts as a stop pin to limit the longitudinal movement of the lock bar.

Figure 5:
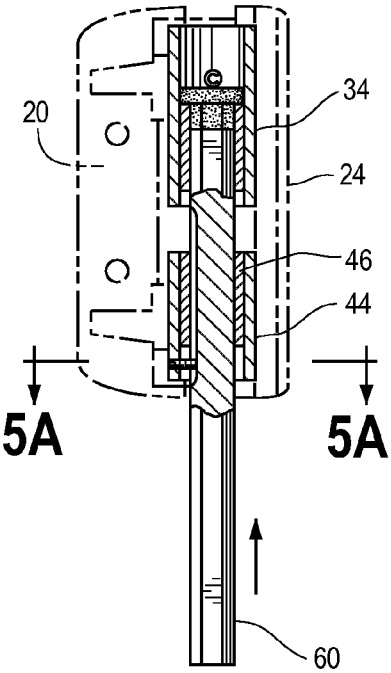
FIG. 5 is a partial cross sectional view similar to that of FIG. 4 but showing the locking pin positioned to prevent rotation of the hinge assembly.
Figure 4A:
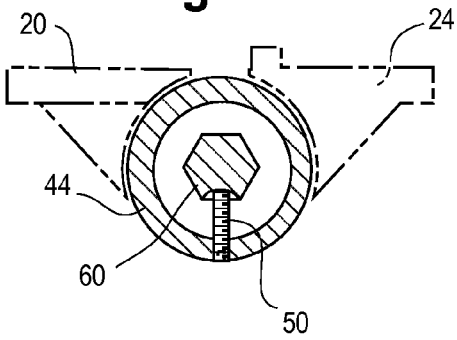
FIG. 4A is a cross sectional view taken along line 4A-4A of FIG. 4.
Figure 5A:
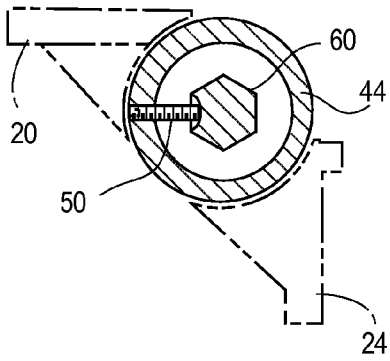
FIG. 5A is a cross sectional view taken along line 5A-5A of FIG. 5.
Figure 6:
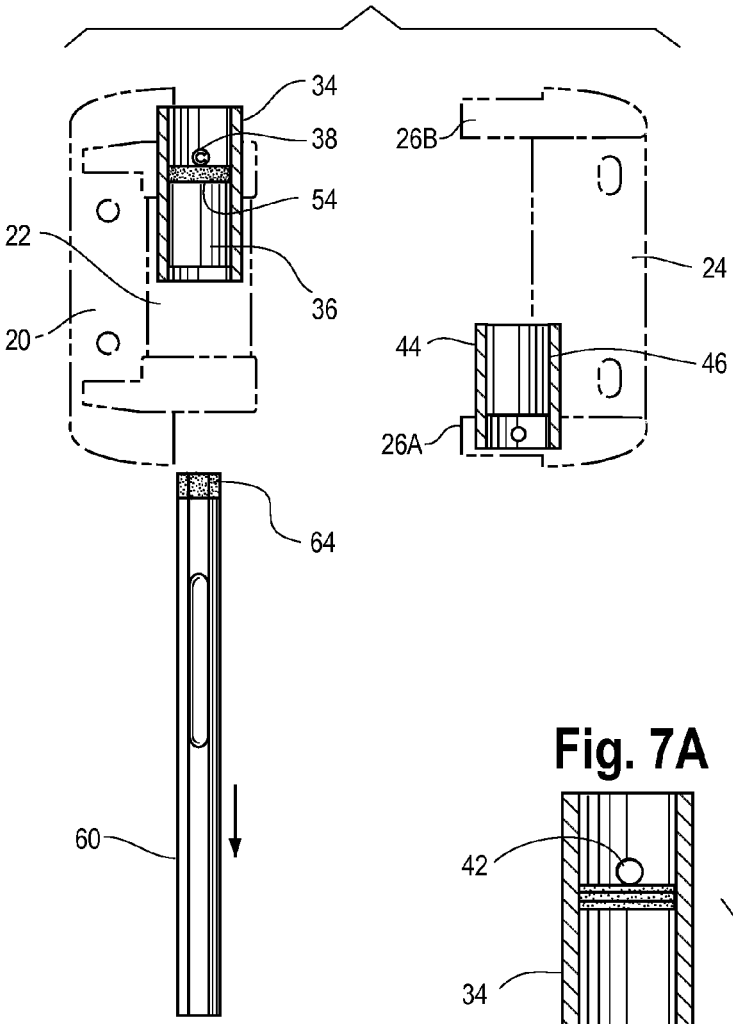
FIG. 6 is an exploded view in partial cross section illustrating certain internal design features of the embodiment shown in FIG. 2.
Figure 7A:
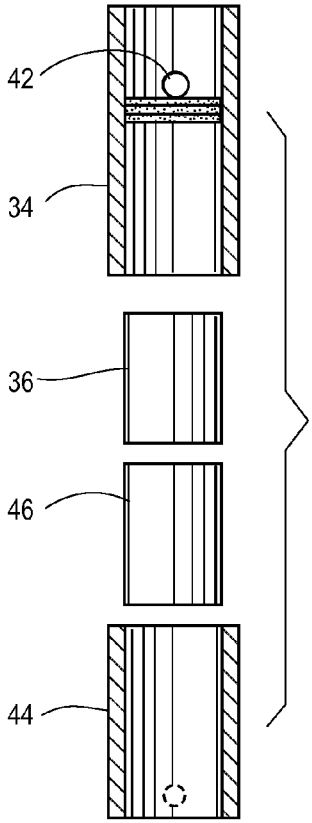
FIGS. 7A and 7B are exploded views in partial cross section again illustrating various internal design features of certain components used in the embodiment shown in FIG. 2.
Figure 7B:
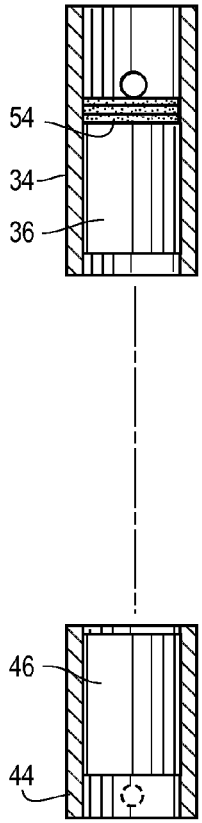

FIGS. 4, 4A, 5 and 5A show the operation of the preferred embodiment. When oriented vertically, gravity will act to drop the lock bar 60 to its lower position. With the set screw 50 engaging the uppermost end of groove 62, the lock bar 60 is held at this lower position. In this lower position, the lock bar 60 is completely disengaged from the internal bore 30 of the upper sleeve 34 and insert 36 of the hinge pin assembly. When so arranged, the first hinge leaf 20 and second hinge leaf 24 are free to rotate, and the gate 12 (or other structure with which the hinge assembly 10 is associated) may swing freely. When the lock bar 60 is pushed up into the internal bore 30 of insert 36 (as shown in FIG. 5), the two hinge leaves are locked or prevented from rotating relative to one another and the gate 12 is held in an open position. The magnet 54 attracts the ferrous end 64 of the lock bar to hold the lock bar in this upper position, maintaining the hinge assembly in the locked position. However, the lock bar may be easily pulled down to overcome this magnetic attraction, and the hinge assembly will once again be free to rotate, thereby allowing the gate to close. Alternatively, the magnet may be affixed to the end 64 of lock bar 60 and the disc 54 may be a ferrous alloy material to thereby provide the magnetic latching function.

In the embodiment illustrated in FIGS. 2-7B, the upper portion of the hinge pin assembly is mechanically tied to hinge knuckle 22 via pin 38, while the lower portion of the hinge pin assembly is mechanically tied to hinge pin knuckle 26 via set screw 50. With this arrangement and with the lock bar 60 in the lock position, the entire hinge assembly is mechanically tied to prevent any rotation. However, in this circumstance there is the potential for damage or even complete failure of the hinge assembly if substantial forces are input to the gate. Because the gate creates a substantial moment arm, these forces are greatly amplified and can break the hinge assembly.

Figure 8:
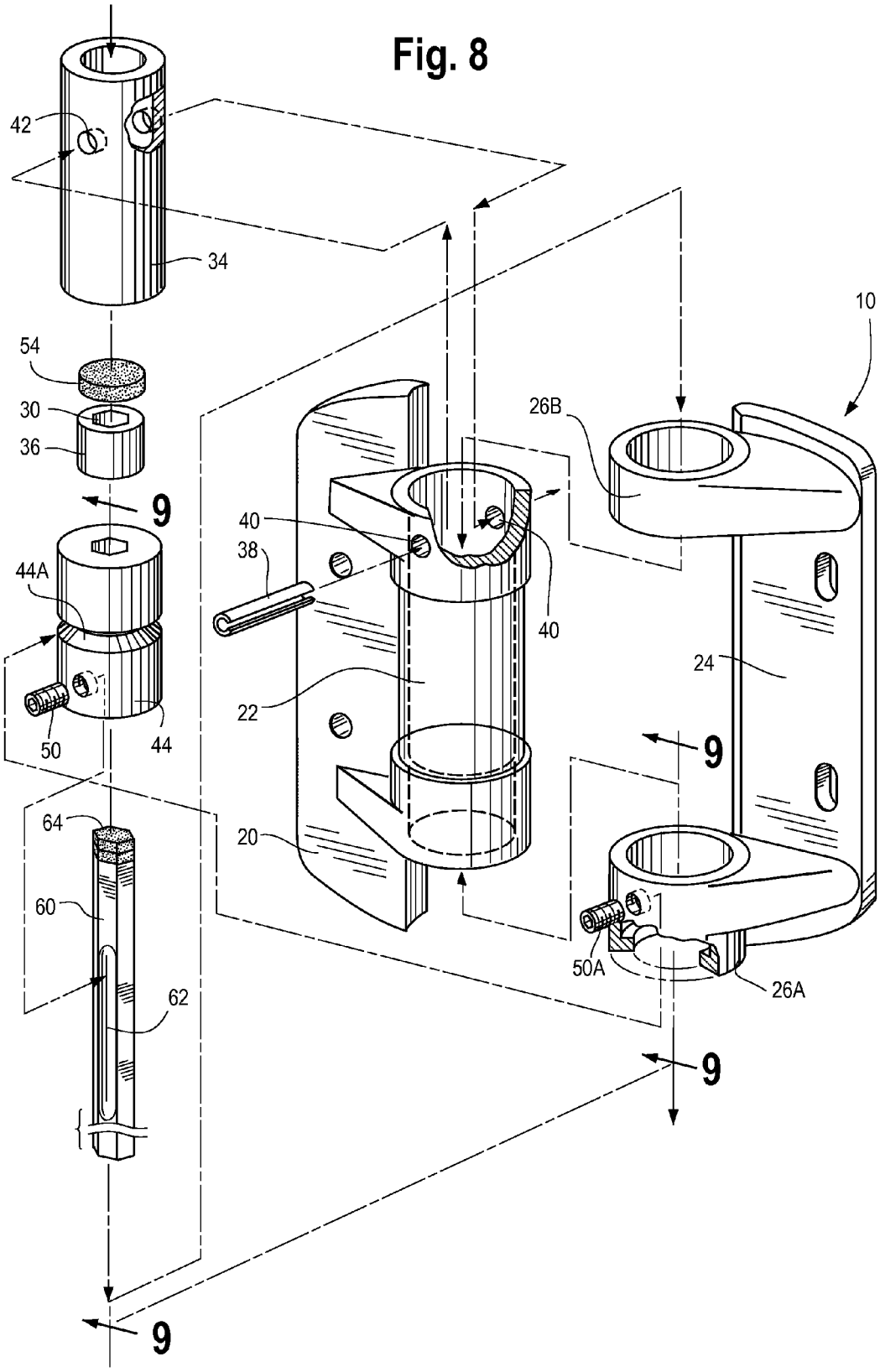
FIG. 8 is an exploded perspective view of another preferred embodiment of the invention showing the details of construction for various components of the hinge assembly.
Figure 9:
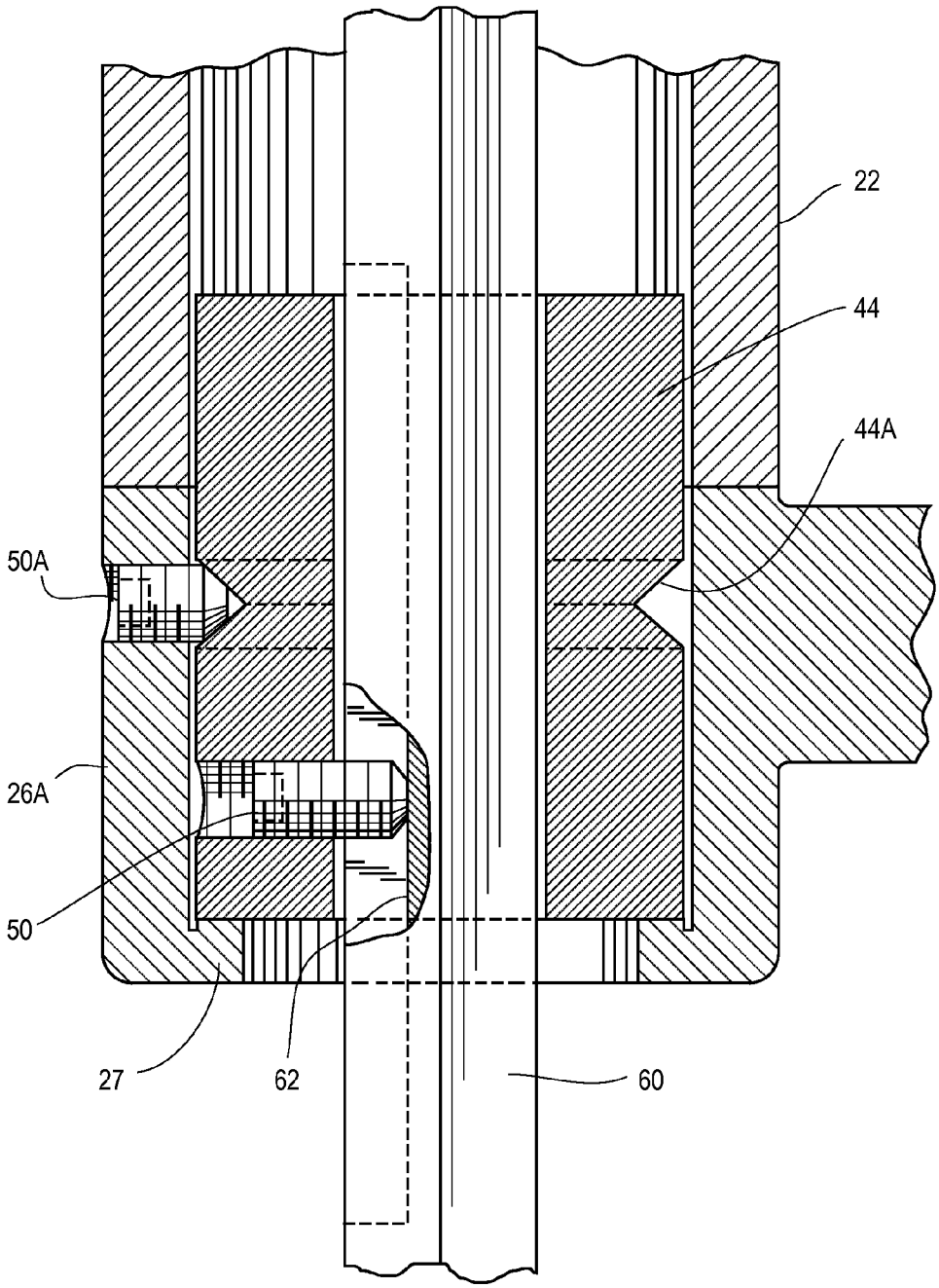
FIG. 9 is a partial cross sectional view taken along line 9-9 of FIG. 8.

The embodiment illustrated in FIGS. 8 and 9 includes a force release device to overcome this problem. in this embodiment, the force release device comprises an annular recess 44A in insert 44 and a set screw 50A which engages the recess to frictionally tie the lower knuckle segment 26A to the hinge pin assembly. Set screw 50 is located within insert 44 and still operates to limit the travel of lock bar 60, but it does not function to mechanically join the hinge pin assembly with the knuckle segment 26A as in the previously described embodiment. When set screw 50.A is tightened, the hinge assembly operates in the same fashion as previously described to lock the gate in an open position when the lock bar is in the upper locked position. However, if a substantial force is applied to the gate while in the locked position, these forces will override the frictional engagement of the set screw 50A, without causing any damage to the assembly. If necessary, the set screw 50A may simply be tightened again. Also, in the event set screw 50A is too loose or removed, the insert 44 will remain in its proper position within knuckle segment 26A by reason of the bottom flange 27.

While the hinge assembly 10 may be fabricated from a variety of materials, it is desirable that its components be made from plastics or metal alloys, such as stainless steel, which limit or eliminate oxidation.

It will be appreciated by those skilled in the art that various changes and modifications can be made to the illustrated embodiments without departing from the spirit of the present invention. For example, in the illustrated embodiment, the magnetic latch member holds the lock bar in the hinge locking position, but the lock bar might also be held in the hinge free rotation position by the magnet, with the lock bar being pushed down to engage the locking position. Likewise, other means will be apparent to those skilled in the art to retain the lock bar within the hinge assembly.

One alternative would include a radially extending element, such as a collar or other protuberance, on the lock bar which would engage a stop affixed to one of the hinge members to thereby limit the lock bar's longitudinal movement. Also, the disclosed embodiments show the hinge assembly 10 in use with two self closing hinges 16, and it is also apparent that the hinge 10 might be used with only one self closing hinge 16 or some other mechanism designed to bias the gate 12 toward the closed position. All such modifications and changes are intended to be covered by the appended claims.

I claim:

1. A hinge assembly movable between an open position and a closed position, the hinge assembly comprising:

a first hinge member including a first cylindrical body portion, a second hinge member including a second cylindrical body portion, a hinge pin assembly, the first and second cylindrical body portions overlying and housing the hinge pin assembly and having common longitudinal axes so that the first and second hinge members are rotatable to move the hinge assembly between the open and closed positions, the hinge pin assembly having upper and lower components, with the upper component mechanically tied to rotate with one of the hinge member body portions and the lower componont mechanically tied to rotate with the other of the hinge member body portions, each of the upper and lower components including an internal bores with a non circular cross section, and the axis of each internal bore being aligned with the axis of the other internal bore, a lock bar positioned within the internal bores of the hinge an assembly and having a size and cross section adapted to engage the internal bores of the hinge pin assembly, the lock bar being movable longitudinally between a first position and a second position, so that when the lock bar is in the first position it engages the internal bores of both hinge pin assembly components and the first and second hinge members are not rotatable relative to one another, and when the lock bar is in the second position it engages the internal bore of only one hinge pin assembly component and the first and second hinge members are rotatable relative to one another, and a magnetic latch cooperating between one of the first or second hinge members and the lock bar to hold the lock bar in one of the first or second positions.

2. The hinge assembly of claim 1 wherein said lock bar includes a longitudinally extending groove and one of said first or second body portions includes a stop pin which cooperates with the lock bar groove to limit the longitudinal movement of the lock bar.

3. The hinge assembly of claim 1 wherein said lock bar includes a radially extending element and one of said first or second body portions includes a stop which cooperates with the lock bar extending element to limit the longitudinal movement of the lock bar.

4. The hinge assembly of claim 1 wherein the magnetic latch comprises a magnetic disc mounted in one of the upper or lower components of the hinge pin assembly and said lock bar has one end composed of a ferrous material and located to magnetically couple to said disc.

5. The hinge assembly of claim 1 wherein one of the upper or lower components of the hinge pin assembly is mechanically tied to its associated hinge member body portion by means of a force relief device.

6. The hinge assembly of claim 5 wherein said force relief device comprises a set screw threaded into the associated hinge body member and frictionally engaging said one upper or lower component.

7. The hinge assembly of claim 6 further including an annular recess in said one upper or lower segment component which cooperates with said set screw.

* * * * *